US011986082B2

(12) United States Patent
Stamenic

(10) Patent No.: US 11,986,082 B2
(45) Date of Patent: May 21, 2024

(54) PARENTAL UTILITY BELT SYSTEM

(71) Applicant: Jasmine Stamenic, Winter Park, FL (US)

(72) Inventor: Jasmine Stamenic, Winter Park, FL (US)

( * ) Notice: Subject to any disclaimer, the term of this patent is extended or adjusted under 35 U.S.C. 154(b) by 3 days.

(21) Appl. No.: 17/708,940

(22) Filed: Mar. 30, 2022

(65) Prior Publication Data

US 2022/0312943 A1 Oct. 6, 2022

Related U.S. Application Data

(60) Provisional application No. 63/169,460, filed on Apr. 1, 2021.

(51) Int. Cl.
*A45F 3/14* (2006.01)
*A45F 5/02* (2006.01)

(52) U.S. Cl.
CPC ..... *A45F 3/14* (2013.01); *A45F 5/021* (2013.01); *A45F 2003/144* (2013.01)

(58) Field of Classification Search
CPC ..... A45F 3/14; A45F 5/021; A45F 2003/144
See application file for complete search history.

(56) References Cited

U.S. PATENT DOCUMENTS

| | | | | |
|---|---|---|---|---|
| 10,477,949 | B2 * | 11/2019 | Wall | A45F 5/021 |
| 2005/0258203 | A1 * | 11/2005 | Weaver | A45F 5/004 224/904 |
| 2007/0205235 | A1 * | 9/2007 | Knight | A45F 5/00 224/681 |
| 2009/0095785 | A1 * | 4/2009 | Woolery | A45F 5/02 224/183 |
| 2012/0180197 | A1 * | 7/2012 | Cosky | A41F 9/002 2/338 |

* cited by examiner

*Primary Examiner* — Corey N Skurdal
(74) *Attorney, Agent, or Firm* — Jason T. Daniel, Esq.; Daniel Law Offices, P.A.

(57) ABSTRACT

A parental utility belt system includes an elongated belt having a front surface, a back surface, a first end and a second end. An elongated metal connector is positioned within the front surface and extends from the first end to the second end of the belt. A magnet and buckle are positioned along the second end of the belt to secure the belt about the waist of a user. A plurality of removable accessories is provided with the system. One of the accessories includes a main body having a magnet along a back side and a cord having a clip extending from the front side. Another accessory includes a mesh body having an elastomeric band and a magnet. Another accessory includes a waterproof body having a magnet on the back side.

16 Claims, 6 Drawing Sheets

PARENTAL UTILITY BELT SYSTEM

CROSS-REFERENCE TO RELATED APPLICATIONS

This application claims the benefit of U.S. Application Ser. No. 63/169,460 filed on Apr. 1, 2021, the contents of which are incorporated herein by reference.

TECHNICAL FIELD

The present invention relates generally to baby products, and more particularly to a belt for removably storing child and infant accessories.

BACKGROUND

The statements in this section merely provide background information related to the present disclosure and may not constitute prior art.

There is no shortage of commercially available diaper bags for use by parents and other caregivers to store baby accessories such as diapers, bottles and wipes, for example. Although useful when traveling, such devices provide little to no actual benefit for everyday use in the home environment. This is because the items stored within the bag are not readily accessible and a parent must rifle through a bag to attempt to find one or more of the items.

Moreover, parents of small children must often juggle multiple duties while at home, in addition to providing constant care and attention to their infants or toddlers. To this end, many parents often joke that they simply do not have enough hands to do everything at once.

For these reasons, it would be beneficial to provide a parental utility belt that can be customized by a parent or guardian to provide a multitude of child accessories in an easy to reach location without the drawbacks described above.

SUMMARY OF THE INVENTION

The present invention is directed to a parental utility belt system. One embodiment of the present invention can include an elongated belt having a front surface, a back surface, a first end and a second end. An elongated metal connector can be positioned along or beneath the front surface and can extend from the first end to the second end of the belt. A magnet can be positioned along the back surface of the belt at a location adjacent to the second end, and a buckle is positioned along the second end. The magnet and buckle can function to secure the belt about the waist of a user.

A plurality of removable accessories can be provided with the system. One of the accessories can include a main body having a magnet along a back side to engage the connector on the front surface of the belt, and an elongated cord extending from a front side. The distal end of the cord can include a loop or a clip for engaging a secondary item such as a baby binky, for example.

In one embodiment, one of the removable accessories can include a mesh body having a closed bottom end and a top end that is enclosed by an elastomeric band. The mesh body can be shaped and sized to receive a plurality of diapers or a baby bottle, and a magnet can be positioned along a portion of the mesh body to engage the connector on the front surface of the belt.

In one embodiment, one of the removable accessories can include a waterproof body for receiving and storing wet wipes. A magnet can be positioned along the back end of the main body to engage the connector on the front surface of the belt.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
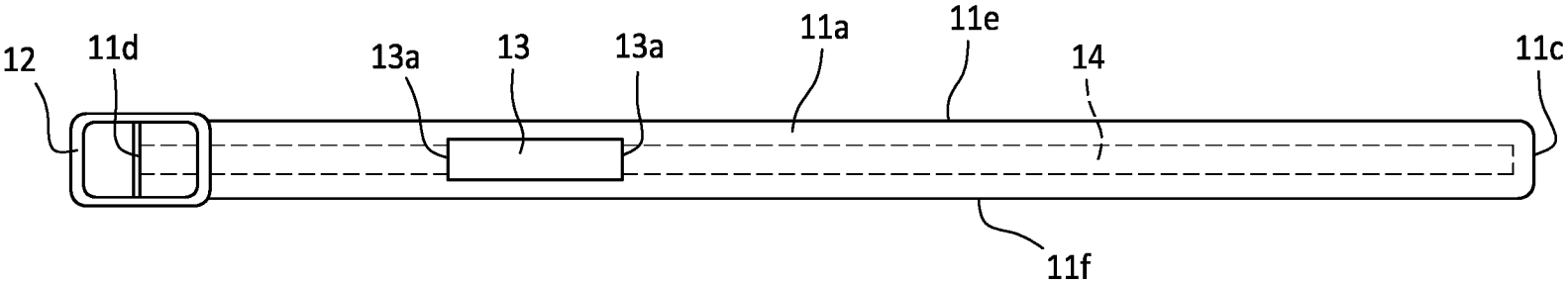
FIG. 1A is a top view of the belt portion of the parental utility belt system, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described throughout this document, the term "about" "approximately" "substantially" and "generally" shall be used interchangeably to describe a feature, shape or measurement of a component within a tolerance such as, for example, manufacturing tolerances, measurement tolerances or the like.

As described herein, the term "removably secured," "removably engage" and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together (via a complementary connector) to repeatedly join two items together in a nonpermanent manner. Several nonlimiting examples of connectors and complementary connectors include, but are not limited to: attractively-oriented magnetic elements, a magnetic element and a metallic element, opposing strips of hook and loop material (i.e. Velcro®), flexible strips of interlocking projections with a slider (i.e., zipper), a thin, flexible strap with a notched surface and one end threaded through a locking mechanism (i.e., zip tie) at the other, tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-6 illustrate one embodiment of a parental utility belt system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1A.

Figure 1B:
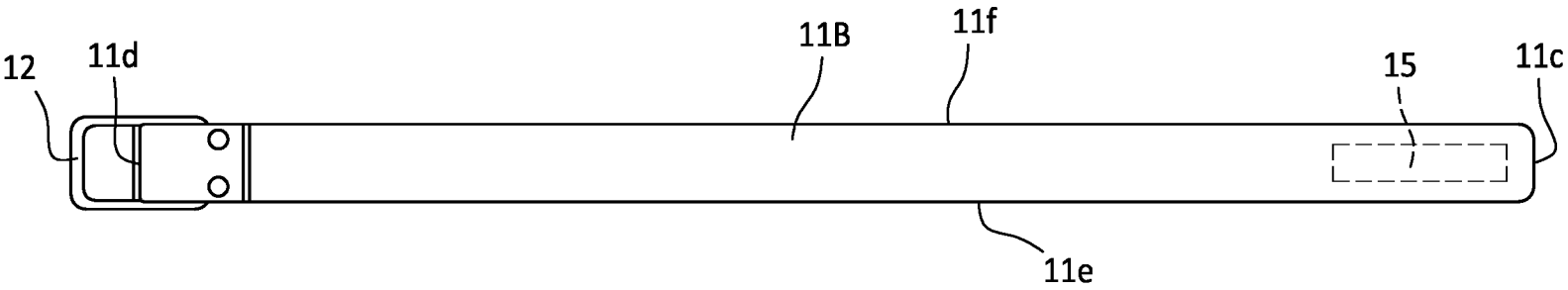
FIG. 1B is a bottom view of the belt portion of the parental utility belt system, in accordance with one embodiment of the invention.

As shown best in FIGS. 1A and 1B, one embodiment, the belt 11 can include an elongated main body member having a front surface 11*a*, a back surface 11*b*, a first end 11*c*, a second end 11*d* and a pair of side edges 11*e* and 11*f*.

In the preferred embodiment, the belt 11 can be constructed from a generally soft and malleable material such as silicone, for example. The use of silicone is of particular importance as the rubber-like qualities impart high resistance to prevent movement and sliding of the below described removable accessories 30, 40 and 50, while not interfering with the magnetic attractive qualities of the components. Of course, other embodiments are contemplated wherein different types of materials including various cloth/fiber materials such as nylon, malleable plastics/polymers, and/or various composite materials are also contemplated.

In one embodiment, a buckle 12 can be secured along the second end 11*d* and can function to receive and secure the first end 11*c* in the closed position so as to be worn about the waist of a user. In one embodiment, an optional strap 13 can be positioned along a portion of the main body so as to extend outward from the top surface. The strap will preferably be constructed from an elastomeric member such as rubber, for example, and can be secured onto the main body on both ends via stitches 13*a* or other such connectors.

The strap can function to receive and hold a secondary item such as a cellphone, for example, however, any number of other items can also be positioned between the middle portion of the strap and the body section to be held in place via compressive force.

In one embodiment, the belt can include a first connector 14 that extends between the first end 11*c* and the second end 11*d*. In the preferred embodiment, the first connector can comprise an elongated malleable strip of metal such as AISI 304 stainless steel, for example, that is positioned just beneath (e.g., 1-2 mm) the top surface 11*a* of the main body. The first connector can function to engage the respective connectors of the below described removable accessories, so as to permit any number of secondary items to be removably suspended from the belt.

In one embodiment, a second connector 15 can be positioned along or embedded within the bottom surface 11*b* of the main body at a location adjacent to the first end 11*c*. In the preferred embodiment, the second connector can include an elongated neodymium magnet that can be positioned just beneath (e.g., 1-2 mm) the bottom surface.

As shown in the drawings, connector 15 can function to removably engage the first connector 14 when the belt is in the closed position, so as to function as a secondary buckle mechanism to prevent the belt from slipping off the user during operation. The connectors also functioning to secure the first end against the main body to prevent the end from hanging loosely when the belt is being worn.

Although described with regard to a metallic strip and/or particular type of magnet this is for illustrative purposes only, as other embodiments are contemplated wherein other types of connectors are utilized. In such a situation, the respective connectors of the below described removable accessories would be complementary to the type of connector used for component 14 so as to be able to be removably secured thereto.

Figure 2:
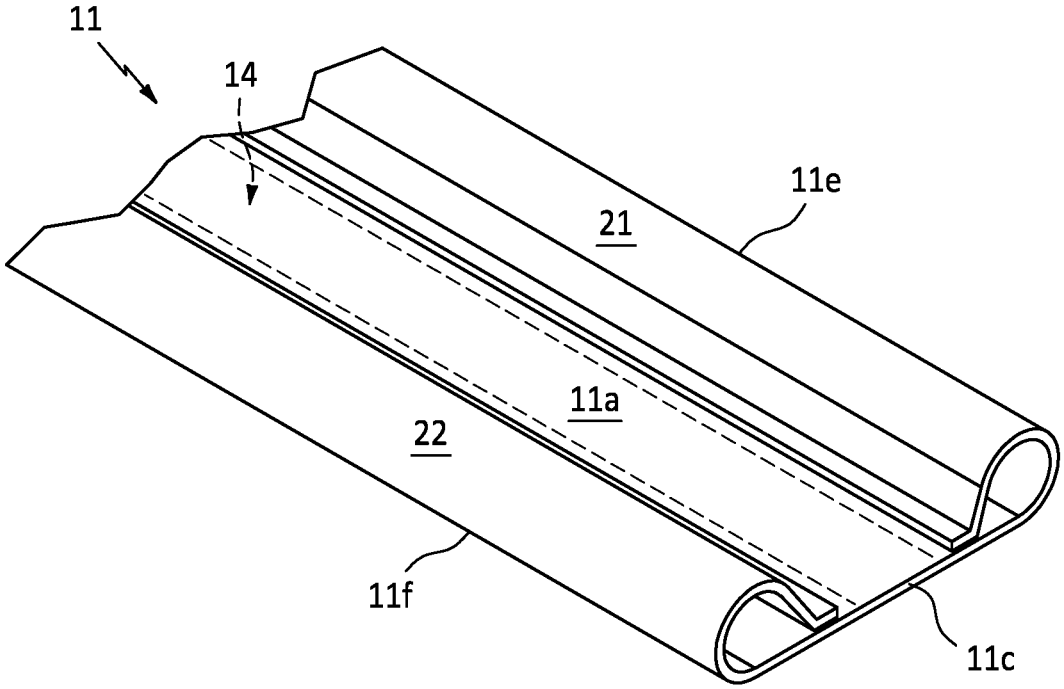
FIG. 2 is a perspective cutout view of the front surface of the belt portion of the parental utility belt system, in accordance with one embodiment of the invention.

As shown best at FIG. 2, the preferred embodiment of the main body can be constructed to include a raised lip area 21 and 22 extending outward from the top surface 11*a* at locations between the metallic strip 14 and the side edges 11*e* and 11*f* of the belt. As noted above, the metallic strip is preferably embedded 1-2 mm beneath the surface of the main body to ensure the greatest possible magnetic attraction between the strip and the below described removable accessories. To this end, each of the raised lip sections 21 and 22 function as a physical barrier to prevent the connectors of the removable accessories from sliding down and becoming separated from the belt during operation.

Figure 3:
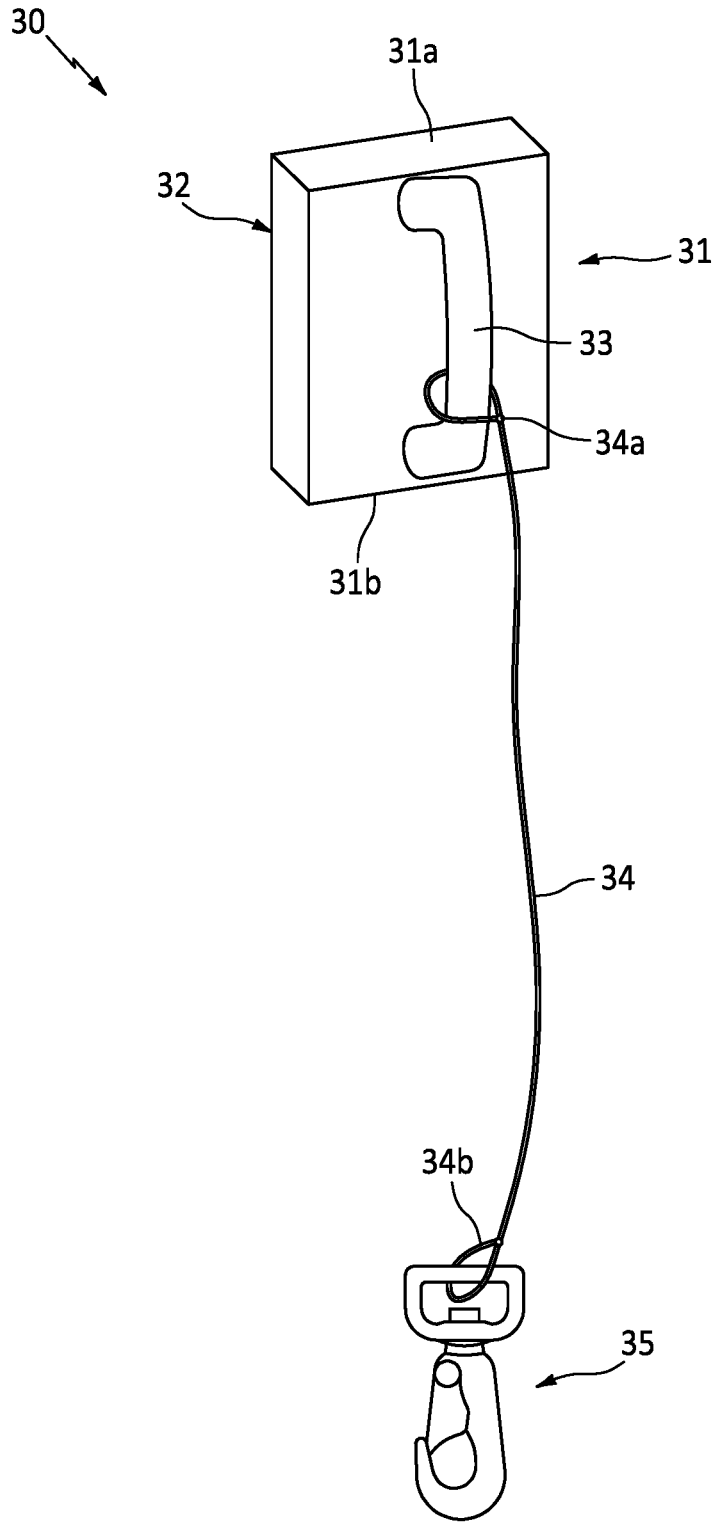
FIG. 3 is a perspective view of the corded accessory of the parental utility belt system, in accordance with one embodiment of the invention.

FIG. 3 illustrates one embodiment of a removable accessory in the form of a corded attachment device 30 for use with the belt 11. As shown, the device can include a body section 31 having a top end 31*a*, a bottom end 31*b*, a connector 32 along the back end and a loop 33 along a front end.

In the preferred embodiment, the body section can be constructed from a strong, lightweight and nonmagnetic material such as plastic, for example. Likewise, the connector 32 will preferably comprise a neodymium magnet that will engage the metallic strip 14, in order to removably secure the attachment device 30 onto the belt. Of course, connector 32 can include, comprise or consist of any number of other types of connectors that are complementary to the type of connector used in element 14 if the same is not the above-described metallic strip.

In the preferred embodiment, the body section 31 can include a height (e.g., distance between top and bottom ends 31*a* and 31*b*) that is complementary to the distance between the raised lip sections 21 and 22 of the belt. Such a feature permitting the main body to be positioned anywhere horizontally along the length of the belt, while the lip sections function to prevent vertical movement and/or separation of the device 30 from the belt.

Figure 6:
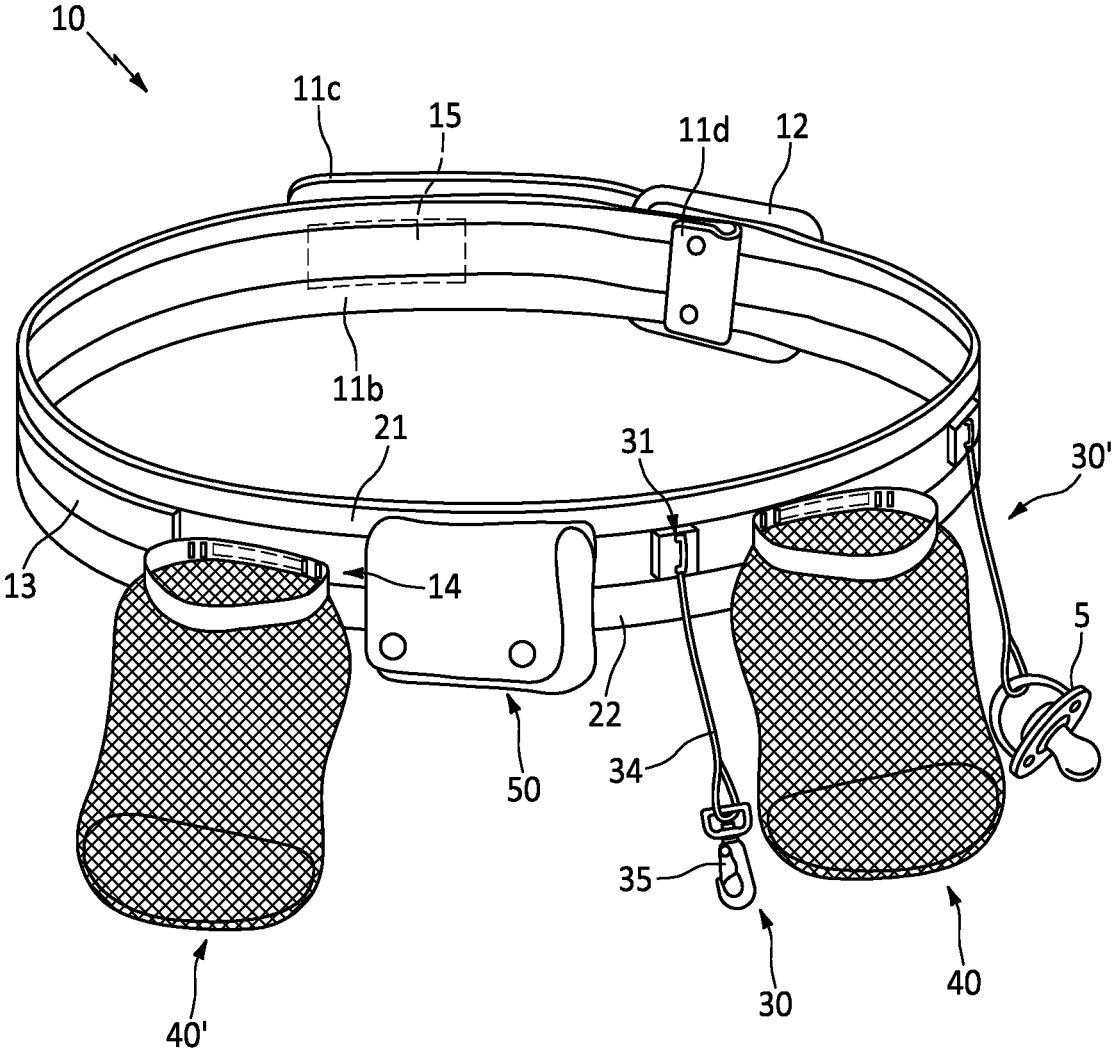
FIG. 6 is a perspective view of the parental utility belt system in operation, in accordance with one embodiment of the invention.

In one embodiment, the first end 34*a* of an elongated cord 34 can be secured onto the loop 33, and the second end 34*b* can include a clip 35, loop or other such component for directly engaging a secondary item such as a child's binky 5, toy or other such item (See FIG. 6).

Figure 4:
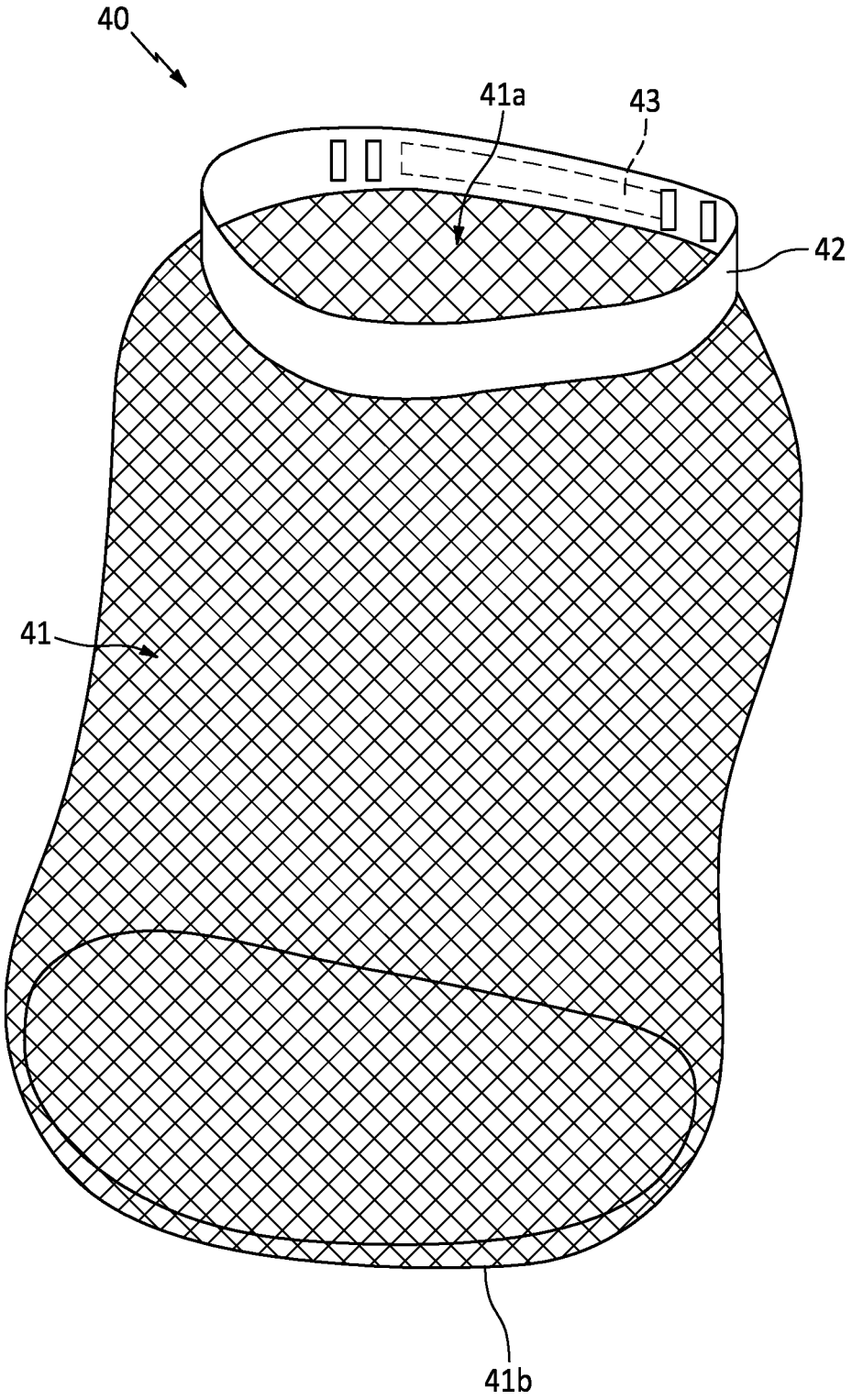
FIG. 4 is a perspective view of the removable diaper holder of the parental utility belt system, in accordance with one embodiment of the invention.

FIG. 4 illustrates one embodiment of a removable accessory in the form of a removable diaper holder 40 for use with the belt. As shown, the diaper holder can include a generally cylindrical mesh body 41 having an open top end 41*a* and a closed bottom end 41*b* forming a pocket area into which a plurality of diapers can be stored. An elastic band 42 can be positioned along the top opening and can function to reduce the size of the opening to prevent inserted diapers or other items from falling out. Likewise, a connector 43—preferably another neodymium magnet—can be embedded within or glued onto the band 42.

The connector 43 can function to engage the metallic strip 14, in order to removably secure the bottle holder 40 onto the belt 11. Of course, connector 43 can include, comprise or consist of any number of other types of connectors that are complementary to the type of connector used in element 14 if the same is not the above-described metallic strip.

Although described as a mesh body for holding a plurality of diapers, this is for illustrative purposes only, as the body section can be constructed from any number of other materials, can include any number of different shapes and sizes, and can be used to house any number of different items. For example, the body 41 can be shaped and sized to receive a baby bottle such that the elastic band 42 engages the side of the bottle to prevent the same from falling out.

Figure 5A:
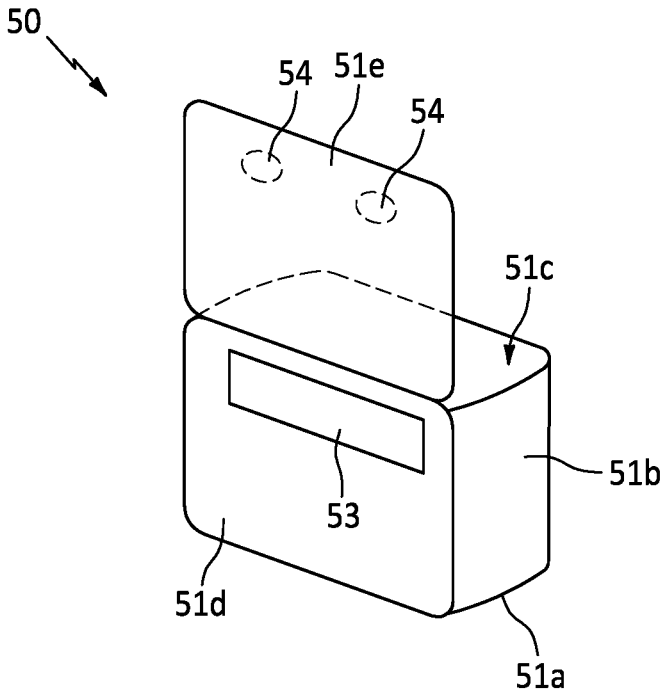
FIG. 5A is a perspective back view of the removable pouch accessory of the parental utility belt system, in accordance with one embodiment of the invention.
Figure 5B:
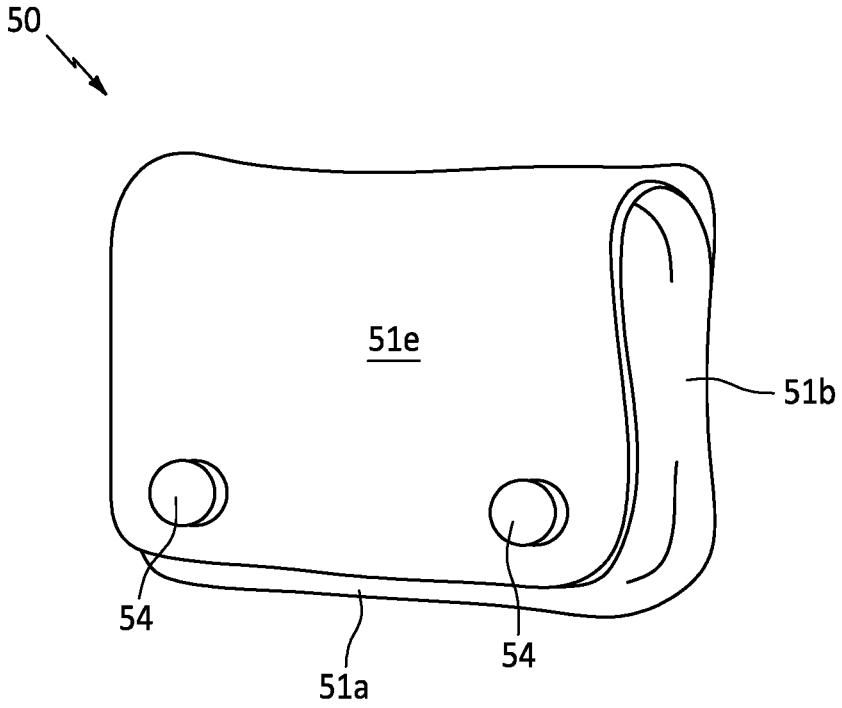
FIG. 5B is a perspective front view of the removable pouch accessory of the parental utility belt system, in accordance with one embodiment of the invention.

FIGS. 5A and 5B illustrate one embodiment of a removable pouch 50 for use with the belt 11 in the open and closed positions, respectively. As shown, the pouch can include a main body having a bottom surface 51*a*, a continuous sidewall 51*b*, an open top end 51*c*, a back end 51*d* and a cover 51*e*. The main body will preferably be constructed from a malleable and waterproof material such as thermoplastic polyurethane, for example, so as to be suitable for receiving and storing wet wipes without allowing the same to dry out.

As shown, a connector 53—preferably another neodymium magnet—can be provided along the back end 51*d* and can function to engage the metallic strip 14, in order to removably secure the pouch onto the belt 11. Of course, connector 53 can also include, comprise or consist of any number of other types of connectors that are complementary to the type of connector used in element 14 if the same is not the above-described metallic strip.

The cover 51*e* can be secured in the closed position via fasteners 54 such as additional magnetic elements or hook and loop material, for example. Although not specifically illustrated, one embodiment of the pouch 50 can include an elongated slit that is bordered by a gasket for permitting a user to selectively remove an individual wet wipe stored within the pouch.

FIG. 6 illustrates one embodiment of the parental utility belt system 10 with two of the above-described corded attachment devices 30 and 30', two of the above-described removable diaper holders 40 and 40', and the pouch 50 secured thereto. In the present embodiment, element 30' is identical to the description of element 30, and element 40' is identical to element 40.

As described above, each of these elements can be secured onto the outside surface of the belt at a location between the raised lip areas 21 and 22 to allow the respective connectors to engage the belt while preventing the items from sliding downward. Although shown with a particular number of devices 30, 40 and 50, this is for illustrative purposes only, as any number of such devices can be provided with the belt or used in conjunction with the belt. Moreover, because each device 30, 40 and 50 is independently removable, these components can be arranged along the belt in any order.

Accordingly, the above-described parental utility belt system provides a novel device for allowing a parent or caregiver to have a plurality of the most commonly needed childcare items readily available without having to search through an enclosed bag or storage area.

As described herein, one or more elements of the parental utility belt system 10 can be secured together utilizing any number of known attachment means such as, for example, glue, stitching, and compression fittings, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A system, comprising:

an elongated belt having a front surface, a back surface, a first end and a second end;

a first connector that is positioned behind the front surface of the belt, and extending continuously from the first end to the second end;

a buckle that is positioned along the second end; and at least one accessory that is configured to receive and engage a secondary item, each of the at least one accessory being configured to removably engage the elongated belt, wherein the front surface includes a pair of raised lip sections extending from the first end to the second end of the belt, wherein the first connector is positioned between the pair of raised lip sections.

2. The system of claim 1, further comprising:

a second connector that is positioned adjacent to the first end of the main body, said second connector functioning as a second buckle to secure the belt in a closed position.

3. The system of claim 1, wherein one of the least one accessory comprises:

a main body having a front end, a back end, and a height that is complementary to a distance between the pair of raised lip sections on the elongated belt;

a complementary connector that is positioned along the back end;

a loop that is positioned along the front end;

an elongated cord having a first end that is secured onto the loop; and a clip that is secured onto a second end of the elongated cord, wherein the complementary connector is configured to removably engage the first connector anywhere along a length of the elongated belt to secure the main body onto the front surface of the elongated belt.

4. The system of claim 3, wherein the first connector comprises an elongated piece of malleable metal.

5. The system of claim 4, wherein the complementary connector comprises a magnet.

6. The system of claim 1, wherein one of the least one accessory comprises:

a main body having a closed bottom end a middle section and an open top end;

an elastic band that is positioned along the top end adjacent to the opening; and a complementary connector that is positioned along the elastic band;

wherein the complementary connector is configured to removably engage the first connector to secure the main body onto the front surface of the elongated belt.

7. The system of claim 6, wherein the main body is constructed from a mesh material and includes a shape and a size that is configured to receive and store a plurality of baby diapers.

8. The system of claim 6, wherein the main body is constructed from a mesh material and includes a shape and a size that is configured to receive and store a baby bottle.

9. The system of claim 6, wherein the first connector comprises an elongated piece of malleable metal.

10. The system of claim 9, wherein the complementary connector comprises a magnet.

11. The system of claim 1, wherein one of the least one accessory comprises:

a main body having a closed bottom end a middle section, an open top end, a back end and a cover; and a complementary connector that is positioned along the back end;

wherein the complementary connector is configured to removably engage the first connector to secure the main body onto the front surface of the elongated belt.

12. The system of claim 11, wherein the main body is constructed from a waterproof material and includes a shape and a size that is configured to receive and store a plurality of baby wet wipes.

13. The system of claim 11, wherein the first connector comprises an elongated piece of malleable metal.

14. The system of claim 13, wherein the complementary connector comprises a magnet.

15. The system of claim 1, wherein the front surface of the elongated belt is constructed from silicone.

16. The system of claim 1, further comprising:

an elastomeric strap having a pair of ends that are connected to the front surface of the elongated belt.

* * * * *